United States Patent [19]

Shavit

[11] 4,142,574

[45] Mar. 6, 1979

[54] OPTIMIZED AIR CONDITIONING SYSTEM

[75] Inventor: Gideon Shavit, Highland Park, Ill.

[73] Assignee: Honeywell Inc., Minneapolis, Minn.

[21] Appl. No.: 537,619

[22] Filed: Dec. 30, 1974

[51] Int. Cl.[2] ..... F25B 29/00

[52] U.S. Cl. ..... 165/16; 165/21; 62/176 R; 236/44 C

[58] Field of Search ..... 165/21, 16; 62/176; 236/44

[56] References Cited

U.S. PATENT DOCUMENTS

| | | | |
|---|---|---|---|
| 2,001,704 | 5/1935 | Bulkeley | 165/16 |
| 2,231,824 | 2/1941 | Bartlett | 236/44 C |
| 3,217,790 | 11/1965 | Wasson et al. | 165/16 |
| 3,568,760 | 3/1971 | Hogel | 165/22 |
| 3,716,096 | 2/1973 | Berrett et al. | 165/22 |

*Primary Examiner*—Charles J. Myhre
*Assistant Examiner*—Margaret LaTulip
*Attorney, Agent, or Firm*—Trevor B. Joike

[57] ABSTRACT

An optimized air conditioning control system is disclosed having a source of return air, a first source of outdoor air and a second source of outdoor air, the mixture of the first source of outdoor air and the return air is controlled at a temperature such that the combination of the mixed air and the air from the second source of outdoor air is at a condition dependent upon the zone of a plurality of zones having the greatest demand.

12 Claims, 2 Drawing Figures

OPTIMIZED AIR CONDITIONING SYSTEM

BACKGROUND OF THE INVENTION

This invention relates generally to a mechanism for saving energy in an air conditioning control system. More particularly, the invention relates to an improvement in a pneumatic control system for optimally controlling a condition, such as air temperature, humidity or enthalpy, in a plurality of zones or regions, although the preferred embodiment is directed to temperature control.

The type of control system to which this invention relates typically includes a plurality of zones or regions in each of which a condition such as temperature is independently controlled. A condition responsive device, such as a thermostat, is located in each zone and adjustably controls the condition to a desired level. A common condition changing medium such as hot or cold water operates through a heat exchanger to change the condition of the air being treated.

The conventional single-duct constant volume air system is illustrated in FIG. 1. The system comprises a return air duct and damper, an outdoor air duct and damper, a cooling coil and fan to discharge the mixture of return air and outdoor air to the zones. In those climates which experience freezing conditions, a preheat coil is placed in front of the cooling coil, and its discharge temperature is designed to be in the neighborhood of 45°-50° F. to protect the cooling coil from freezing. Obviously, in those climates where the outdoor air temperature does not drop below freezing, the preheat coil is not necessary. Also, the ventilation codes of many areas dictate that at all times of occupancy there shall be a minimum amount of fresh air supplied to the zones. This requirement is fulfilled by a minimum outdoor air damper. The rest of the air capacity is supplied through a variable outdoor air damper or through a return air duct damper or by a mixture of outdoor air and return air.

Because of varied heating or cooling loads on the various zones, one zone may require more air treatment than another zone. During winter months, the mixture of return air and minimum outdoor air may be preheated to a temperature to satisfy the zone having the greatest demand, i.e. that zone which will not require any reheat. The result of this operation is that there will always be at least one zone which will not require any reheat.

But during the summer months, the moisture content of the outdoor air is high and this air must be dehumidified in order to maintain comfort in the zones. Thus, the mixture of outdoor air and return air has to be cooled to, for example, 50° F. dry bulb and 50° F. dew point, and the air discharged from the fan, therefore, will be at 50° F. If it is assumed that the zones require an air supply of 60° F., this cold air must be reheated before distribution to all zones.

It is to be noted, however, that if, during the summer months, the temperature of the discharge air is controlled such that the space with the highest cooling demand does not require any reheat, there will result a cost saving since there will always be at least one zone that does not require any reheat as opposed to a system wherein the discharge air must be reheated at each zone to the desired temperature. It is thus desireable to extend the increased savings noted during winter operation to the humid months of summer.

SUMMARY OF THE INVENTION

The invention provides a system whereby the minimum outdoor air supplied to the discharge fan of the system is conditioned through a preheat coil, when needed, and a cooling coil independently of the mixture of return air and variable outdoor air. This operation is accomplished by providing a first source of outdoor air, which may be variable, and a second source of minimum outdoor air. Thus, whenever minimum outdoor air with high humidity enters the air handling system, only this air is cooled to a temperature, for example 48° FDB and 48° FDP, whereas the mixed air is cooled only to the level where the combination of the mixed air and the minimum outdoor air will be at the desired discharge air condition as established by the optimization criteria, i.e. the zone having the greatest demand.

The resulting savings is that there will be less reheat required since only the minimum outdoor air must be taken down to 48° FDB and 48° FDP, there will be required less cooling of the air to achieve the desired comfort level and there will be required a smaller preheat coil. That is, the mixture of return air and variable outdoor air is cooled to the optimized temperature rather than, as in a conventional system, to 48° F. so that the discharge air from the fan is already at the optimized temperature and does not require reheat of the air supplied to at least that zone selected to establish the optimization criterium; and, a smaller preheat coil may be used since only the fixed minimum outdoor air must be preheated.

It is to be noted that the present system works equally as well in a variable volume system and in a double duct system having one duct for heating and a second duct for cooling.

Additional advantages of this invention will become apparent from a review of the detailed description of the invention in connection with the drawings in which:

FIG. 1 is a schematic illustration of the prior art air conditioning system; and, FIG. 2 is a schematic illustration of the present invention.

DETAILED DESCRIPTION OF THE DRAWINGS

Figure 1:
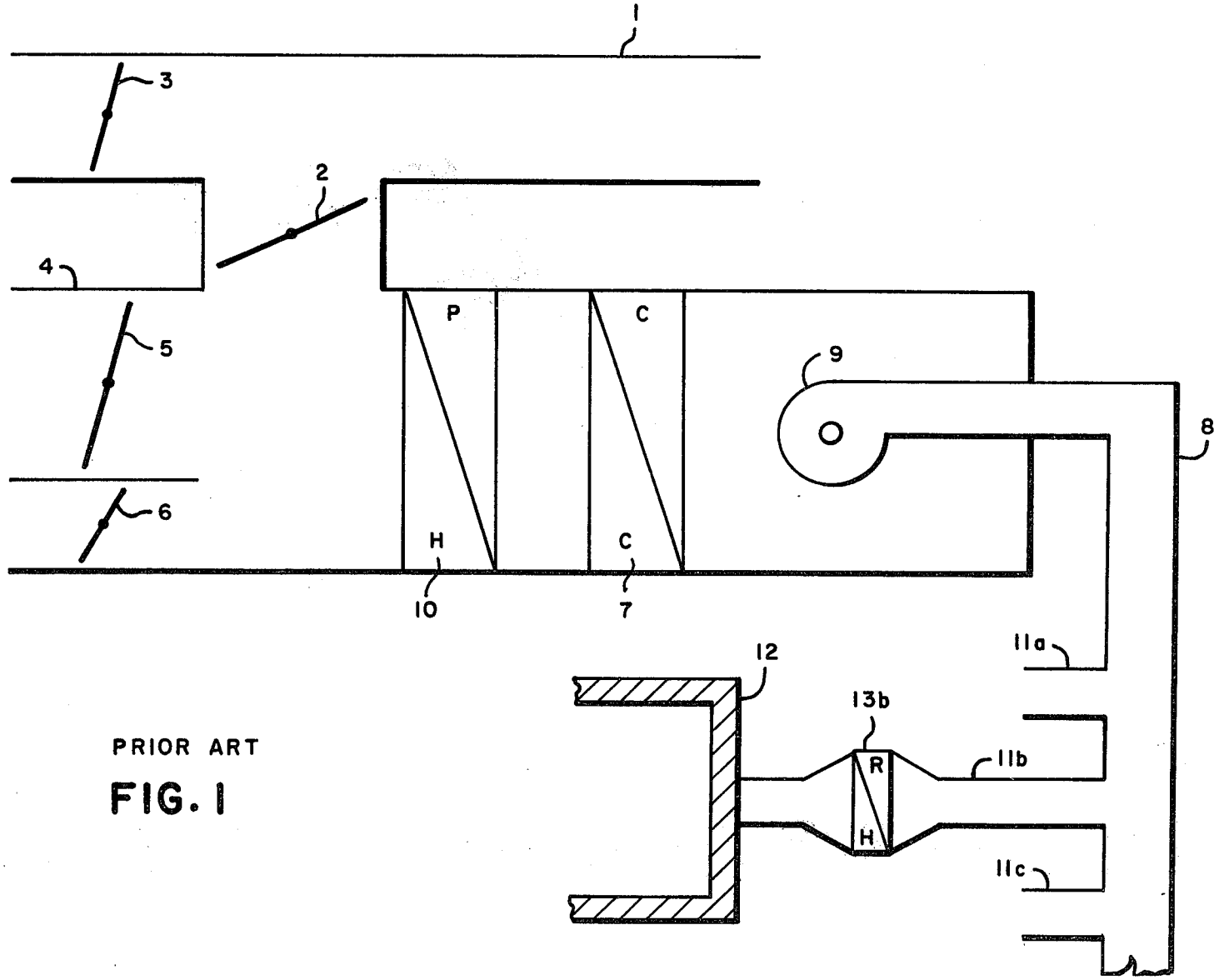
PRIOR ART FIG. 1

The prior art circuit is shown in FIG. 1 and includes a return air duct 1 having a return air damper 2 and an exhaust damper 3 which allows a certain percentage of the return air to be exhausted from the building. An outdoor air inlet duct 4 having a variable outdoor air damper 5 and a fixed outdoor air damper 6 allows fresh air to be mixed with the return air supplied through the return air damper 2. The fixed damper 6 is designed such that the air handling system will ensure that a fixed minimum amount of outdoor air is introduced into the building. The mixture of return air and outdoor air is cooled and dehumidified by a cooling coil 7 and supplied to the discharge air duct 8 by fan 9. A preheat coil 10 is included in those systems were there is a danger of the cooling coil 7 freezing. The discharge air is supplied to a plurality of zone air ducts **11*a* through 11*c* each of which delivers a portion of the discharge air to a corresponding zone one of which is shown as zone 12. The zone duct 11*b*, as do zone ducts 11*a* and 11*b* but not shown, includes a reheat coil 13*b*** which may normally be controlled to bring the temperature of the air supplied to that zone to the desired temperature as established by a corresponding thermostat (not shown) located in that zone.

It is to be noted in this system that the preheat coil extends over the entire duct and, also, that during humid summer months it is necessary to cool the air to a low temperature, for example, 48° F. dry bulb in order to dehumidify the air to a comfortable level. Then the air must be brought back up to the desired room temperature in each of the zones by their corresponding reheat coils.

Figure 2:
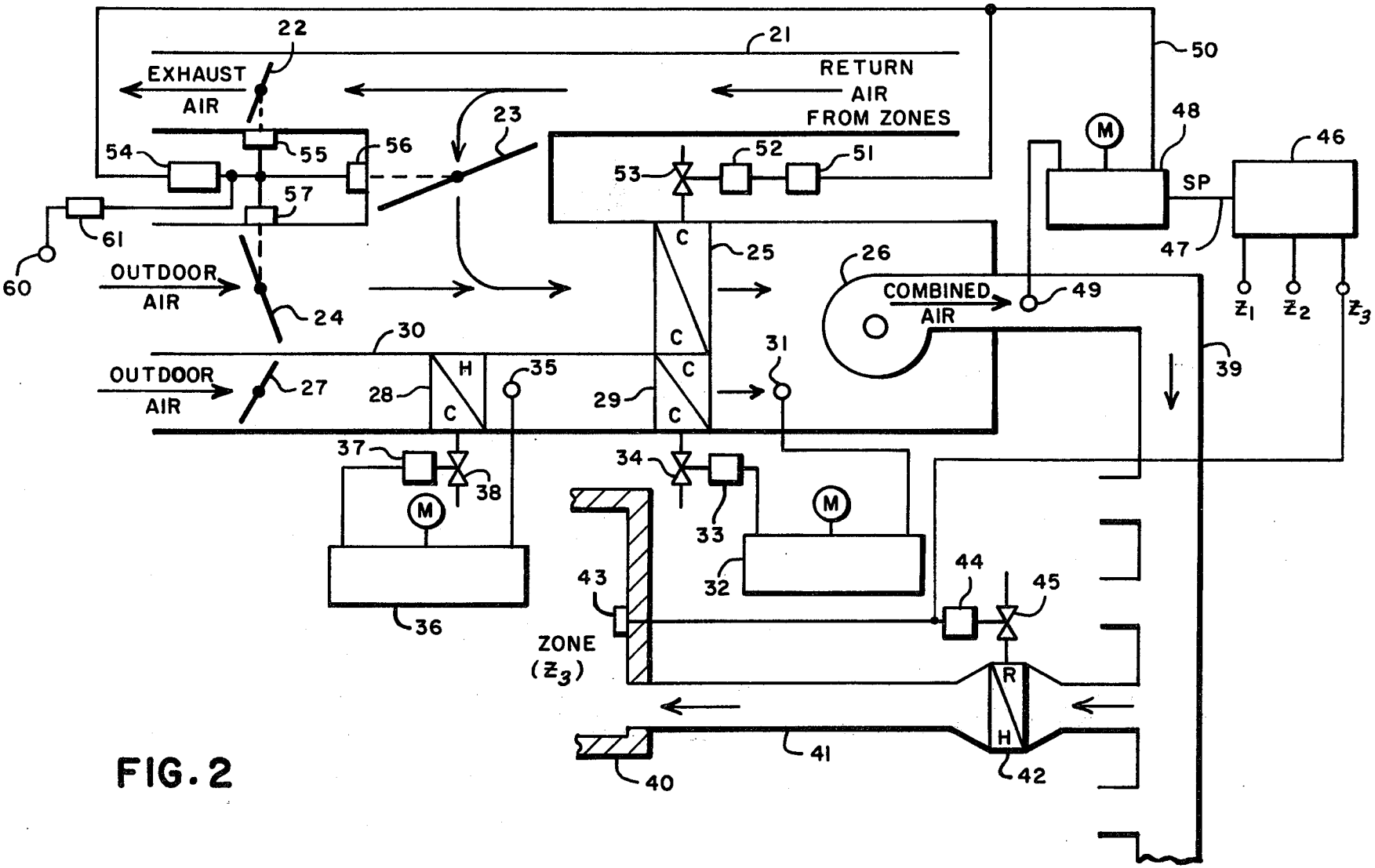

One of the advantages of the instant invention is that the air can both be dehumidified and controlled at a temperature satisfying the zone with the greatest demand. To understand more fully the advantages of the present invention, reference should now be made to FIG. 2.

Return air duct 21 returns the air from the zones, part of which is to be exhausted through exhaust air damper 22 and part of which is supplied through return air damper 23 to be mixed with outdoor air from the variable outdoor air damper 24. The mixture of return air from damper 23 and outdoor air from damper 24 is then supplied through a cooling coil 25 to the fan system 26. Outdoor air is also supplied to fan 26 through fixed outdoor air damper 27, heating coil 28 and cooling coil 29. The outdoor air taken in through damper 24 and damper 27 may be supplied through different ducts but, in the preferred embodiment, the air is supplied through the same duct having a dividing wall 30 therein to separate the variable outdoor air from the minimum fixed outdoor air. The air passing from cooling coil 29 is sensed by a dew point sensor 31 which controls a pneumatic amplifier 32 which may be a Honeywell RP908. This circuit amplifies the signal from 31 and supplies a pneumatic pressure signal to motor 33 to control valve 34 for controlling the cooling medium to coil 29. The dew point sensor 31 is designed to insure that the air leaving the cooling coil 29 during the humid months is, for example, at 48° F. dry bulb and 48° F. dew point.

In those climates which require a preheat coil to protect the cooling coil, a thermostat 35 senses the output from the preheat coil and supplies its output to the input of an amplifier 36 which may also be a Honeywell RP908. The output from the amplifier 36 is supplied to a motor 37 to control valve 38 supplying the heat exchanging medium to the preheat coil 28. The preheat coil 28, under the control of thermostat 35, supplies air to the fan system at, for example, 48° F.

The fan 26 combines the air flow which results from the mixture of return air and variable outdoor air with the air flow from the fixed damper 27 and supplies the resulting discharge air to discharge air duct 39 and the plurality of zones one of which is shown at 40 through a corresponding inlet duct 41. In the inlet duct is a reheat coil 42 controlled by a corresponding thermostat 43 in the zone. The output of the thermostat operates a motor 44 to control valve 45 which supplies a heat exchanging medium to the reheat coil 42.

As can be seen from the description of the prior art, during the humid summer months it is necessary for the prior art apparatus to dehumidify and cool the air to 48° FDB and 48° DP in order to provide a comfortable humidity level in the zones. This air then must be reheated by each of the zones up to the desired level. The apparatus of the present invention not only allows for a higher level of temperature in the discharge air duct 39 but also allows for the selection of the discharge air temperature to satisfy the conditions of at least one zone so that the air supplied to that zone does not need any reheat at all. As can readily be seen, this results in a substantial energy saving.

To further realize this energy saving, the thermostats, such as 43, in each of the controlled zones, Z1, Z2, and Z3, are connected to a pressure selector device 46 which may be of the type shown in U.S. Pat. No. 3,692,240. When a direct acting thermostat is used, the pressure output from the thermostat increases as the temperature increases. Therefore, the pressure selector 46 is designed so that it supplies an output over line 47 representing the lowest of the input pressures from the thermostats of the plural zones. During winter as well as summer, the zone having the "greatest demand", i.e. lowest temperature, is selected such that air supplied to that zone will not require any reheat and the other zones will require only a minimum amount of reheat.

The output over line 47 is supplied to the set point terminal of an amplifier 48 which again may be an RP908. The RP908 can utilize either a manual set point or a pneumatic set point. In the case of amplifier 32 and 36, it is sufficient to use a manual set point although a pneumatic set point can be used. In any event, the amplifier 48 compares the pressure at its set point terminal over line 47 with the pressure derived from a thermostat 49, located to sense discharge air temperature, and the output pressure over a line 50 represents the deviation between the pressure received from the thermostat 49 and the pressure in line 47.

The pressure in line 50 is supplied to sequence circuit 51 and then to motor 52 to control a heat exchange control valve 53 to supply a cooling exchange medium to the cooling coil 25. The pressure in line 50 is also supplied through a second sequencing circuit 54 to operate motors 55, 56 and 57 for positioning corresponding dampers 22, 23, and 24. The sequencing control circuits 51 and 54, which may each be an RP907A manufactured by Honeywell, Inc., insure that dampers 22–24 are operated when the output pressure in line 50 varies from, for example, 3–8 psi and that the valve 53 begins opening when the pressure varies from, for example, 8–13 psi. This means that the dampers 22–24 will be first varied as long as they have the capacity to insure that the temperature of the discharge air from fan 26 is maintained at the temperature chosen as the set point by the pressure in line 47. As soon as these dampers lose their ability to hold the temperature from fan 26 at the desired set point temperature, the cooling coil 25 will then be operative. Thus, for very cold temperatures outdoors, the damper 24 will be fully closed, the damper 23 will be fully opened and the damper 22 will be fully closed. As the temperature outdoors increases the loading on the zones will change such that, in order to maintain the temperature of the discharge air 49 at the desired value, the damper 24 will begin to open and the damper 23 will begin to close and the damper 22 will begin to open. When the outdoor air temperature increases to such a level that the outdoor air cannot maintain the discharge air temperature at the desired level, the cooling coil 25 then begins operation to maintain that temperature. When the outdoor air temperature becomes too high, it is no longer efficient to mix outdoor air with return air. Thus, an outdoor air thermostat 60 and pressure selector circuit 61 are provided to override sequencer 54 and close outdoor air damper 24 when the outdoor air temperature exceeds a predetermined value.

The effect of this operation is that the outdoor air supplied through fixed air damper 27 is normally maintained at 48° F. This air must be combined with the mixture of return air and outdoor air from dampers 23 and 24 such that the combination of these two air flows will result in the desired temperature as established by the pressure selector circuit 46. Therefore, the air mixture from damper 23 and 24 will have to be at a temperature which, when mixed with the air from the minimum air outdoor air damper 27, will result in the combination of the mixed return and outdoor air and the minimum outdoor air at a temperature selected by the pressure selector circuit 46. For example, if it is desired to supply discharge air at 60° F., and the air supplied from the minimum outdoor air damper 27 is at 50° F., it may be necessary to control the mixture of return air and outdoor air from dampers 23 and 24 at, for example, 63° F. since the volume of this air is much greater than the volume of minimum outdoor air.

The system disclosed may be used in a variable volume outdoor air system, i.e. a system wherein instead of or in addition to a reheat coil 42 a variable damper is used to control the amount of air supplied to each zone. Also, the system may be used in a double duct system wherein one duct supplies heated air to the zones and a second duct supplies cooling air to the zones. This type of system is particularly useful in large office buildings that have interior as well as exterior offices. Interior offices are not so affected by outside air conditions as are the external offices. Therefore, while specific embodiments have been disclosed herein, one does not depart from the scope of the invention by using alternative means. Accordingly, it is intended that the scope of the invention be limited only by scope of the claims.

The embodiments of the invention in which an exclusive property or right is claimed are defined as follows:

1. A building air conditioning system for optimally controlling a condition in air discharged to a plurality of zones, said building air condition system having return air source means for providing return air from said zones, first and second outdoor air source means for providing first and second portions of outdoor air, a mixing chamber for mixing return air and said first portion of outdoor air, mixed air controlling means for controlling said condition of said mixed air, said mixed air controlling means having a return air damper for controlling said return air and a first outdoor air damper for controlling said first portion of outdoor air, cooling means for said second portion of outdoor air, discharge means for supplying discharge air comprising a combination of the mixed air and the second portion of outdoor air to said zones, said system comprises:

first means for sensing the condition of the zone having the greatest demand;

second means for sensing the condition of the discharge air; and, third means connected to said first and second means and to said mixed air controlling means whereby said mixed air is controlled such that, when said mixed air is combined with said second portion of outdoor air, said discharge air will substantially satisfy said zone having the greatest demand.

2. The system of claim 1 wherein said mixed air controlling means further comprises a cooling coil for said mixed air.

3. The system of claim 2 wherein said third means comprises an amplifier connected to said first and second means and having an output and a sequencing means connected to receive said output of said amplifier for first controlling said first outdoor air damper and said return air damper over a first selected output range of said amplifier and for controlling the cooling coil of the mixed air over a second selected output range of said amplifier.

4. The system of claim 3 wherein said system comprises means for controlling said cooling means for said second portion of the outdoor air at a preset condition.

5. The system of claim 1 comprising means for controlling said cooling means for said second portion of the outdoor air at a preset condition.

6. The system of claim 5 wherein said mixed air controlling means further comprises a cooling coil for said mixed air.

7. The system of claim 3 comprising a preheat coil for insuring that the second portion of air does not fall below a preset condition.

8. In a building air conditioning system for reducing the energy necessary to maintain a desired condition of air discharged to at least one zone, said system comprising:

a source of return air;

first and second sources of outdoor air creating corresponding first and second flows of outdoor air;

air treatment means for conditioning a mixture of return air and said first flow of outdoor air, said air treatment means having an outdoor air damper for controlling said first flow of outdoor air and a return air damper for controlling said return air and cooling means for cooling said mixed air;

cooling means for conditioning said second flow of outdoor air at a first condition;

control means connected to said air treatment means for controlling said mixed air at a second condition such that, when combined with said second flow of outdoor air, the combination will be at said desired condition of said air discharge to said zone; and, means for combining said mixed air and said second flow of outdoor air.

9. The system of claim 8 wherein said system comprises a plurality of zones and wherein said control means comprises means to select the zone having the greatest demand, means for sensing the condtion of the discharge air and means responsive to said condition of the zone having the greatest demand and the discharge air condition for controlling the outdoor air and return dampers and said cooling means such that said condition of said combined air is such as to satisfy the zone having the greatest damand.

10. The system of claim 8 wherein said system comprises a plurality of zones and wherein said control means comprises condition selecting means for selecting the condition of the zone having the greatest demand, sensing means for sensing the condition of the discharge air and means responsive to said selecting means and said sensing means for controlling the outdoor air and return air dampers and said cooling means resulting in a condition of said mixed air such that when the mixed air is combined with the second flow of air, the discharge air will be at a condition of the zone having the greatest demand.

11. The system of claim 10 further including a preheat coil located in said second flow of outdoor air.

12. A building air conditioning system for optimally controlling a condition in air discharged to a plurality of zones, said building air condition system having return air source means for providing return air from said zones, first and second outdoor air source means for providing first and second portions of outdoor air, a mixing chamber for mixing return air and said first portion of outdoor air, mixed air controlling means for controlling said condition of only said mixed air, cooling means for supplying said second portion of outdoor air, discharge means for supplying discharge air comprising a combination of mixed air and the second portion of outdoor air to said zones, said system comprises:

first means for sensing the condition of the zone having the greatest demand;

second means for sensing the condition of the discharge air; and, third means connected to said first and second means and to said mixed air controlling means whereby said mixed air is controlled such that, when said mixed air is combined with said second portion of outdoor air, said discharge air will substantially satisfy said zone having the greatest demand.

* * * * *